United States Patent [19]

Bowman et al.

[11] Patent Number: 4,771,941

[45] Date of Patent: Sep. 20, 1988

[54] MAILBOX SERVICE SIGNALING DEVICE

[76] Inventors: Tracy L. Bowman, 424 Belinda Pkwy., Mt. Juliet, Tenn. 37122; Wesley A. Melvin, 251-A Lisa La., Nashville, Tenn. 37210

[21] Appl. No.: 40,275

[22] Filed: Apr. 20, 1987

[51] Int. Cl.[4] ..... B65D 91/00

[52] U.S. Cl. ..... 232/35

[58] Field of Search ..... 232/35, 34, 17

[56] References Cited

U.S. PATENT DOCUMENTS

| | | | |
|---|---|---|---|
| 3,408,978 | 11/1968 | Duffey | 232/35 |
| 3,559,878 | 2/1971 | Roeder | 232/35 |
| 3,750,939 | 8/1973 | Hallett | 232/35 |
| 3,968,928 | 7/1976 | Caldwell | 232/35 |
| 4,072,265 | 2/1978 | Jones | 232/35 |
| 4,182,479 | 1/1980 | Swift | 232/35 |
| 4,382,541 | 5/1983 | Miller | 232/35 |

*Primary Examiner*—Robert W. Gibson, Jr.
*Attorney, Agent, or Firm*—Pitts and Brittian

[57] ABSTRACT

A service signaling device (10) for a mailbox (20) having a door (14) pivotally mounted proximate the bottom (18) of the mailbox. A signal indicating arm (40) is mounted proximate the lower edge (12) of the mailbox door and moves between set and triggered positions. When the arm is in the set position, and secured to the bottom of the mailbox door (14), it indicates a lack of service to the mailbox. When the mailbox door (14) is opened, the arm (40) moves to its triggered position to indicate that service to the mailbox has been completed. An attachment mechanism (26) serves to mount the signal arm (40) on the lower edge of the door. A catch (54) serves to hold the arm (40) in its set position until the door is opened.

9 Claims, 2 Drawing Sheets

MAILBOX SERVICE SIGNALING DEVICE

DESCRIPTION

1. Technical Field

This invention relates to mailbox signaling devices, and more particularly to a service signaling device for a mailbox which is triggered by the opening of the mailbox door. The device includes a signal arm which in its set position is secured to the bottom or floor of the mailbox. It is moved from this position to the triggered or signaling position upon opening the mailbox door by pivoting it in a downwardly direction.

2. Background Art

It will be appreciated by those skilled in the art that a plurality of mailbox signaling devices have heretofore been known. These devices are generally designed to be attached to conventional mailboxes such as those used in rural areas. The devices are triggered or moved to a signaling position upon opening the mailbox door. This is normally done by a mailman and indicates that the mailbox has been serviced either by the deposit or removal of mail. Such devices are particularly convenient in inclement weather, since they provide a true indication as to whether the mailbox has been serviced. In this regard, the need for periodic visits to the mailbox is eliminated since the owner can check the box by visual inspection.

Known prior art devices which are designed to indicate the service of mailboxes are described and illustrated in the following U.S. Pat. Nos.: 2,581,880; 3,150,361; 3,523,639; 3,559,878; 3,572,581; 3,648,924; 3,650,464; 3,750,939; 3,794,240; 3,815,811; 4,182,479; 4,363,438; 4,365,740; 4,372,481; 4,372,482; 4,383,439; 4,382,540; 4,382,541; 4,382,542; 4,390,122; 4,447,005; 4,449,663 and 4,473,182. While these known devices may adequately serve the purpose of providing a signal to the mailbox owner that the box has been serviced, known prior devices are, in some respects, difficult to install and maintain.

Accordingly, it is an object of the present invention to provide a mailbox signaling device which can be readily installed and easily maintained.

Another object of the present invention is to provide such a device which is mounted on the lower edge of the mailbox door and triggered when the mailbox is moved from its closed position towards its open position.

Another object of the present device is to provide a catch which secures the signaling arm to the floor or lower portion of the mailbox and which releases the signaling arm upon movement of the door or opening.

DISCLOSURE OF THE INVENTION

Other objects and advantages will be obvious, and will in part appear hereinafter and will be accomplished by the present invention which provides a service signaling device for a mailbox. This device includes a signal indicating arm which moves between set and triggered positions. When the arm is in the set position, it is secured to the bottom of the box by a catch. This catch is released upon moving the door in a downwardly pivoting direction for opening. The device can be readily mounted on the edge of the door by an attachment mechanism which in the preferred embodiment comprises a clamp that slidably receives the lower edge portion of the door and facilitates mounting the device.

BRIEF DESCRIPTION OF THE DRAWINGS

The above-mentioned features of the present invention will be more clearly understood from consideration of the following description in connection with the accompanying drawings in which.

BEST MODE FOR CARRYING OUT THE INVENTION

Figure 1:
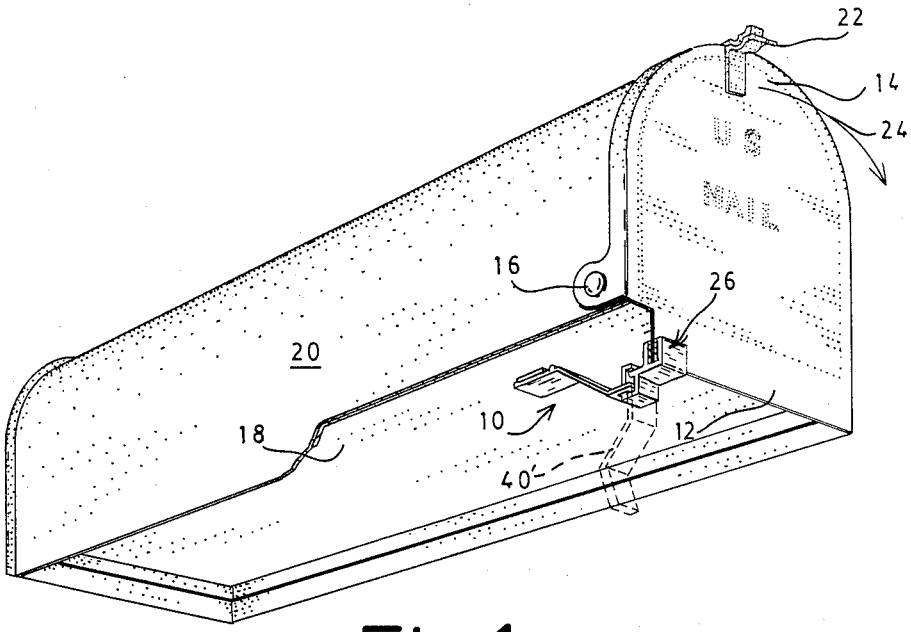
FIG. 1 is a perspective view of a mailbox service signaling device constructed in accordance with various features of the present invention, mounted on the lower edge portion of the door and moved to its set position. The signaling or triggered position is shown by the phantom lines.

Referring now to FIG. 1, a service signaling device constructed in accordance with various features of the present invention is indicated generally at 10. This device 10 is mounted on the lower edge 12 of the mailbox door 14. The door 14 is of generally conventional design and is pivotally mounted at the location 16 proximate the bottom 18 of the mailbox 20. The door opens by gripping the tab 22 and pivoting the door 14 in a downwardly direction as indicated by the arrow 24 about the pivot point 16, and a like pivot point (not shown) on the other side of the mailbox 20.

The service signaling device 10 is mounted proximate the lower edge or lower portion 12 of the door 14. To this end, an attachment mechanism 26 is provided. This attachment mechanism 26 is shown in greater detail in the cross-sectional view of FIG. 2. It will be noted that the attachment mechanism shown in FIG. 2 includes a clamp 28 having members 30 and 32 which slidably receive the lower portion 12 of the door 14. These members 30 and 32 are biased towards each other and rounded proximate their end portions 34 and 36, respectively. In this manner, the lower portion 12 of the door can be inserted between the clamping members 30 and 32. The biasing force of these members towards each other serves to grip the lower portion 12 of the door and secure the attachment mechanism 26 thereon. It will be noted in FIG. 2 that a plurality of gripping fingers 38 are carried by the members 30 and 32. These gripping figers enhance the frictional engagement between the attachment mechanism 26 and the lower edge portion 12 of the door and assist in preventing the device 10 from sliding therefrom.

Figure 2:
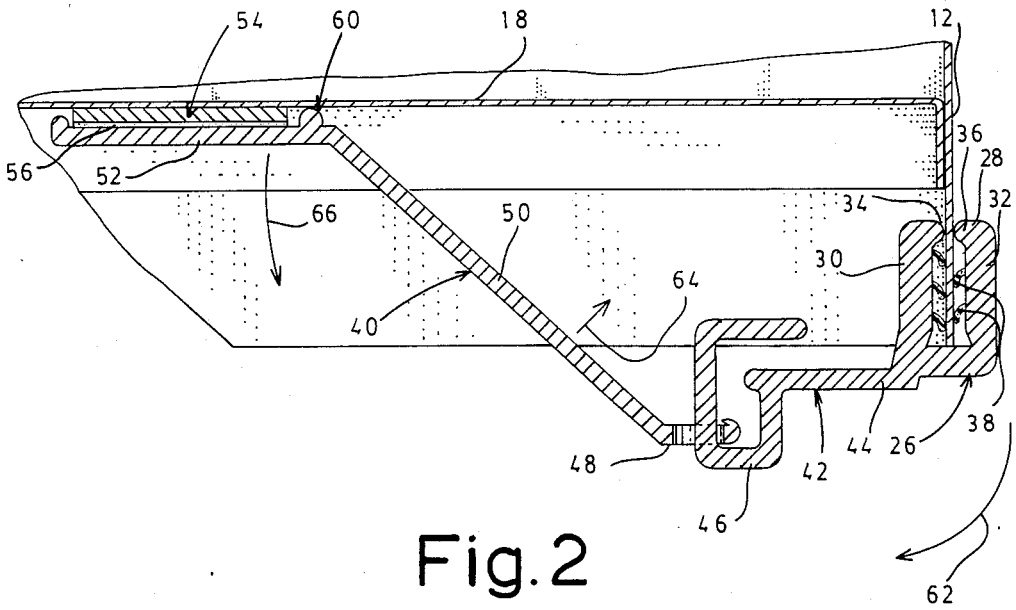
FIG. 2 illustrates a cross-sectional view of the device shown in FIG. 1.

A signal indicating arm 40 is pivotally mounted in the preferred embodiment on the attachment mechanism 26. More specifically, the attachment mechanism 26 carries a signal arm support member 42 which in the preferred embodiment shown in FIG. 2 includes a member 44 which extends substantially parallel with the floor 18 of the mailbox 20 when the door 14 is closed. This member 44 is integrally formed with the attachment mechanism clamp 26 and terminates in a coupling 46 which is substantially G-shaped. It will be noted in FIG. 2 that this coupling 46 is integrally formed with the member 44 and pivotally receives lower section 48 of the signal indicating arm 40. As shown in FIG. 2, section 48 of the signal indicating arm 40 defines an opening which receives and is pivotally carried by and coupled with the member 42.

The signal indicating arm section 48 is integrally formed with arm section 50 which extends from the G-shaped member 46 to the bottom 18 of the mailbox when the arm 40 is in the set position as indicated in FIG. 2. This section 50 is integrally formed with, and forms an obtuse angle with, section 52 of the arm. This section 52 extends in a substantially parallel manner with the bottom 18 of the box and with the section 48 of the arm. It will be noted that sections 50 and 52 also form an obtuse angle in the embodiment depicted.

The attachment mechanism 26 and the signal indicating arm 40 are preferably fabricated from a semi-rigid material such as plastic having a preselected width and thickness. Further, in order to reduce the cost of manufacturing, the attachment mechanism and the signal indicating arm are designed such that they can be extrusively molded or fabricated from other suitable inexpensive manufacturing processes.

A catch generally indicated at 54 serves to hold the arm 40 in its set position until the door is opened. In the preferred embodiment, the catch 54 comprises a magnet which is secured to the exterior and upper surface of the section 52 of the arm 40 in the illustrated embodiment by a suitable adhesive 56. This catch magnet 54 is substantially rectangular in shape and is of sufficient magnetic attraction to hold the arm 40 in the position illustrated in FIG. 2 until the door is opened. In this regard, the catch magnet 54 attracts the ferromagnetic bottom 18 of the mailbox such that the device 10 is maintained in the set position shown in FIG. 2 until the door is opened.

Means generally indicated at 60 serve to release the catch 54 upon moving the mailbox door 14 to its opened position. The release means 60 serves as a fulcrum to activate the signal indicator arm 40. To this end, when the mailbox door is opened in a downwardly pivoting direction illustrated by the arrow 24 in FIG. 1, the attachment and clamp mechanism 26 is pivoted in a direction generally indicated by the arrow 62 in FIG. 2. This causes section 48 of the arm to be forced upwards in the direction of the arrow 64 which causes the release mechanism 60 to serve as a fulcrum. More specifically, as the lower end section 48 of the arm moves in the direction of the arrow 64 the catch 54 is forced down in the direction of the arrow 66 until the fulcrum 60 contacts the bottom of the mailbox (if it does not already do so). This motion will cause the magnetic catch 54 to be pried away from the metallic surface of the bottom 18 of the mailbox. Gravity then acting upon the arm 40 will cause the signal arm to break away from the bottom of the box when the door is opened to approximately 45 degrees in the preferred embodiment.

When the door is closed again the signal arm 40 will hang down at approximately 90 degrees with respect to the horizontal plane of the bottom of the mailbox 20.

This signal arm is then clearly visible below the bottom of the mailbox at the position 40' indicated in phantom lines (see FIG. 1) to indicate to the owner that the box has been serviced.

After postal materials or other mail have been removed from the box by the owner, and the door is returned to its closed position, the device can be returned to its set position again by merely lifting the signal arm 40 with one hand until the magnetic catch 54 contacts the bottom of the mailbox. Upon opening the mailbox to approximately 45 degrees as indicated above, the signal arm will again be released and moved to its triggered position for indicating mailbox service.

Figure 3:
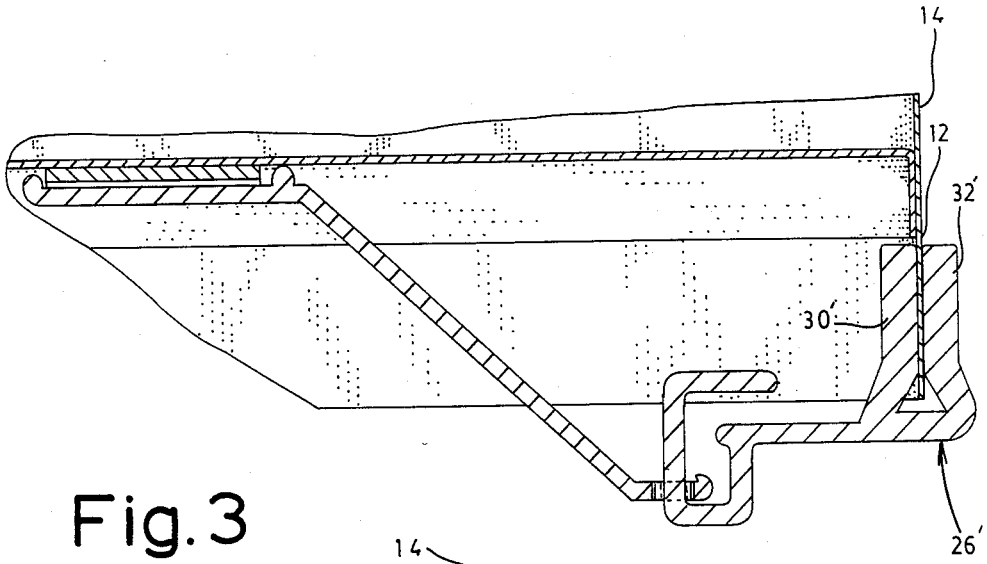
FIG. 3 illustrates an alternate embodiment of the device shown in FIG. 1.

FIG. 3 illustrates an alternate embodiment of the attachment mechanism 26. More specifically, the attachment mechanism 26' as shown in FIG. 3, includes a pair of clamping members 30' and 32' which receive the lower portion 12 of the door 14 proximate the lower edge of such door. These clamping members 30' and 32' frictionally engage the opposite exterior surfaces of the lower portion of the door and secure the device 10 thereon.

Figure 4A:
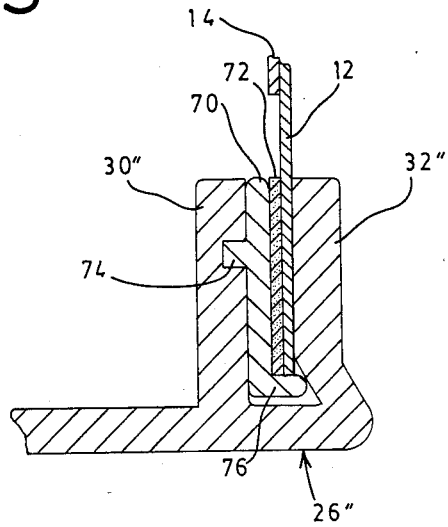
FIG. 4A illustrates an alternate embodiment of a suitable attachment mechanism for securing the device to the door.

FIG. 4A illustrates another alternate embodiment of the attachment mechanism 26. This mechanism 26'' includes a pair of clamping members 30'' and 32''. Member 32'' engages the forward exterior surface of the lower portion 12 of the mailbox door 14. The attachment mechanism 26'' shown in FIG. 4A includes members 70 and 72 which enhance the securement between the device 10 and the lower portion 12 of the door. Member 70 is substantially L-shaped in cross-sectional outline and includes a detent 74 which is slidably received in the registering groove defined in the member 30''. This L-shaped member 70 includes the lower leg 76 which engages the lower most edge portion of the door 12. Member 72 is an adhesive which joins the member 70 to the lower portion of the door 12 as illustrated. The attachment mechanism 26'' shown in FIG. 4A is mounted by first attaching the member 70 on the lower portion of the door with the adhesive and then sliding the clamp members 30'' and 32'' such that member 70 and its detent are juxtaposed to the member 30''.

Figure 4B:
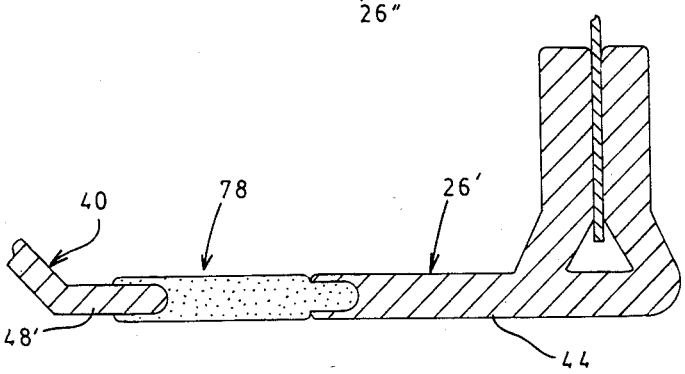
FIG. 4B illustrates an alternate embodiment of the attachment device and a member which serves to pivotally join the attachment device with the signal indicating arm.

FIG. 4B illustrates an alternate embodiment for pivotally mounting the signal indicating arm 40. The pivotal mounting means is generally indicated at 78 and comprises a substantially flexible plastic or rubber material which is molded such that one end portion is fixed to the section 44 of the attachment mechanism 26' and the opposite end is fixed to the lower section 48' of the arm 40. This means 78 is flexible and bends such that the arm 40 pivots with respect to the attachment mechanism 26' as the door is opened and the release mechanism 60 is activated.

From the foregoing detailed description, it will be recognized that an improved service signaling device for a mailbox has been provided. The device is designed such that it can be fabricated from state-of-the-art molding techniques, and in the preferred embodiment it is extrusively molded. The signal indicating arm is released from the lower portion of the box upon movement of the door by a preselected amount normally about 45 degrees. It is designed such that it pivots with respect to its attachment mechanism and hangs downwardly at approximately 90 degrees with respect to the horizontal plane of the bottom of the box after it is triggered. In this manner, it can be readily seen by the mailbox owner.

Thus, although there has been described to this point particular embodiments of the present invention of a service signaling device for a mailbox, it is not intended that such specific references be considered as limitations upon the scope of this invention except insofar as set forth in the following claims and the equivalents thereof.

We claim:

1. A service signaling device for a mailbox having a door pivotally mounted proximate the bottom of said mailbox and opening in a downwardly pivoting direction, said device being secured proximate the lower edge of said mailbox door, comprising:

a signal indicating arm for movement between set and triggered positions, said arm being in the set position to indicate a lack of service to said mailbox and being in the triggered position to indicate service to said mailbox;

a clamp for receiving said lower edge of said mailbox door for mounting said signal arm proximate said lower edge of said door; and a catch for holding said arm in its set position until said door is opened such that said catch releases said arm for movement to the triggered position indicating service to said mailbox.

2. The service signaling device of claim 1 wherein said signal indicating arm is pivotally mounted on said clamp to facilitate movement of said arm to said triggered position after said catch is released.

3. The signaling device of claim 1 wherein said catch comprises a magnet which secures a portion of said signal indicating arm to said bottom of said mailbox for securing said arm in the set position.

4. The signaling device of claim 3 including means for releasing said magnetic catch upon said mailbox door being opened in said downwardly pivoting direction.

5. The service signaling device of claim 4 wherein said means for releasing said magnetic catch comprises a fulcrum which acts against said bottom of said mailbox to pry said catch therefrom upon said mailbox door being opened in said downwardly pivoting direction.

6. The service signaling device of claim 1 wherein said signal indicating arm comprises a first section which is pivotally mounted on said clamp, and a second section integrally formed with said first section at an obtuse angle, said second section carrying said catch which serves to hold said arm in its set position until said door of said mailbox is opened.

7. A service signaling device for a mailbox having a door pivotally mounted proximate the bottom of said mailbox and opening in a downwardly pivoting direction, said device being secured proximate the lower edge of said mailbox door, comprising:

a signal indicating arm for movement between set and triggered positions, said arm being in the set position to indicate a lack of service to said mailbox and being in the triggered position to indicate service to said mailbox;

a clamp for receiving said lower edge of said mailbox door for mounting said signal arm proximate said lower edge of said door, said signal indicating arm pivotally mounted on said clamp to facilitate movement of said arm to said triggered position;

a magnetic catch carried by said signal indicating arm and magnetically attracting said bottom of said mailbox for holding said arm in its set position until said door is opened such that said catch releases said arm for movement to the triggered position indicating service to said mailbox; and means carried by said arm for releasing said magnetic catch upon said mailbox door being opened in a downwardly pivoting direction.

8. The service signaling device of claim 7 wherein said means for releasing said magnetic catch comprises a fulcrum which acts against said bottom of said mailbox to pry said catch therefrom upon said mailbox door being opened in said downwardly pivoting direction.

9. The service signaling device of claim 8 wherein said signal indicating arm comprises a first section which is pivotally mounted on said clamp, and a second section integrally formed with the said first section at an obtuse angle, said second section carrying said catch which serves to hold said arm in its set position until said door of said mailbox is opened.

* * * * *